United States Patent [19]

Hystad

[11] Patent Number: 5,015,178

[45] Date of Patent: May 14, 1991

[54] MELTING FURNACE

[75] Inventor: Per H. Hystad, Kopervik, Norway

[73] Assignee: Karmoy Winch A/S, Kopervik, Norway

[21] Appl. No.: 325,535

[22] Filed: Mar. 20, 1989

[30] Foreign Application Priority Data

Mar. 25, 1988 [NO] Norway ..... 881337

[51] Int. Cl.[5] ..... F27B 14/08

[52] U.S. Cl. ..... 432/248; 432/252; 432/247; 266/900; 266/275

[58] Field of Search ..... 432/247, 248, 251, 252; 266/275, 285, 242, 900; 110/336

[56] References Cited

U.S. PATENT DOCUMENTS

| | | | |
|---|---|---|---|
| 404,414 | 6/1889 | Jones | 266/275 X |
| 2,589,301 | 3/1952 | Smith | 266/900 X |
| 2,662,764 | 12/1953 | Arutunoff | 266/900 X |
| 2,741,470 | 4/1956 | Barkley | 432/252 |
| 2,950,570 | 8/1960 | Cowles et al. | 266/900 X |
| 3,363,889 | 7/1966 | Shirley et al. | 432/247 |
| 3,429,562 | 3/1967 | Hewlett, Jr. | 432/252 X |
| 4,362,500 | 12/1982 | Eriksson et al. | 432/223 |

FOREIGN PATENT DOCUMENTS

| | | | |
|---|---|---|---|
| 1426922 | 3/1976 | United Kingdom | 266/275 |

*Primary Examiner*—Henry A. Bennet
*Assistant Examiner*—Christopher Kilner
*Attorney, Agent, or Firm*—Cushman, Darby & Cushman

[57] ABSTRACT

A melting furnace has a supporting structure of thermostable steel, and an internal shell of common steel, serving as a contact area for the refractory lining of the furnace.

2 Claims, 2 Drawing Sheets

MELTING FURNACE

BACKGROUND OF THE INVENTION

The invention relates to a melting furnace or the like, in a design of a steel structure with a refractory lining.

The invention was developed as a consequence of problems arising in connection with melting furnaces for aluminium, and other materials. Such melting furnaces are at present made from common steel which is lined with refractory material.

A typical melting furnace has a length of approximately 8 m, a width of approximately 5 m, and a height of approximately 1.5 m. Such melting furnaces are welded from common sheet material St. (DIN) 42, or St. (DIN) 52-3. The furnaces are provided with an internal lining of a refractory material.

The weight of aluminium and the refractory lining carried by the furnace amounts to 50-80 tons. The load of aluminium and the lining is received by the steel structure of the furnace, which is thus subjected to high bending loads. During operations, the steel material of the furnace is subjected to high temperature loads. Temperatures will vary from approximately 200° C. to 400° C. Over time, the insulating lining will be impaired, and the steel material is sujected to an increased heat load. The structure, as mentioned, being produced from common steel material, which will lose its stability at approximately 200° C., will sag and become lopsided, resulting in fracturing and destruction of the refractory lining material.

If it were possible to prevent the furnace from losing its shape, the life of the furnace and its lining could be prolonged. This would result in fewer interruptions for replacements of furnaces, and reduced costs for mending and renovating the furnaces.

SUMMARY OF THE INVENTION

According to the invention a melting furnace is provided with a supporting structure made from thermostable steel with a shell of common steel which is connected with the thermostable steel and is in contact with said refractory lining.

Thermostable steel here designates a thermostable material which will maintain its strength up to a temperature which is higher than the temperature to which the steel material of the furnace is subjected.

The supporting structure should be understood to be the components of the box proper, the components primarily becoming weakened by the continuous heat load. The external, surrounding, supporting and carrying structure may in practicing the invention, as conventionally, be manufactured from a common steel grade, such external structures being sufficiently spaced from the melt to prevent substantial negative influence from the heat load.

In an embodiment of a melting furnace as mentioned above, the furnace will maintain its shape for longer time than common steel conventionally used in such furnace at present. If the refractory lining should become damaged, it will be possible to mend the lining on the spot, without the necessity of moving the furnace to a workshop for mending, since the shape of the furnace is not distorted. This will result in shorter disruptions in the production of aluminium, and highly reduced costs in connection with mending and building new furnaces.

It is important, when practicing the present invention that those parts of the furnace which are subjected to bending moments due to the weight of aluminium and lining, as well as being subjected to heat exchange, are made from thermostable materials which will maintain stability up to a higher temperature than the temperature to which the furnace is subjected.

According to the invention, common steel (St. 42 or St. 52-3), as presently used in a typical furnace, is only used as a shell in the furnace to keep aluminium inside the furnace and to form a contact face for the refractory lining. In this function common steel will only be subjected to insignificant loads (only to pressure from aluminium and lining), since this steel material has nothing to do with the structure supporting the furnace and maintaining the shape of the furnace.

The utilized two steel grades may be welded together and can, thus be welded in a suitable manner.

The invention was discussed above in connection with an embodiment for an aluminium melting plant, but similar problems may arise in melting plants for other materials. When it is underlined that the supporting structure of the furnace should be made from thermostable steel, equivalents are also included, i.e. structural materials having properties corresponding to those of thermostable steel, and common steel, respectively, the essence of the invention residing in the composites structure of the furnace.

BRIEF DESCRIPTION OF THE DRAWINGS

The invention is disclosed in more detail below with reference to the Figures of the drawing, in which.

DETAILED DESCRIPTION

Figure 1:
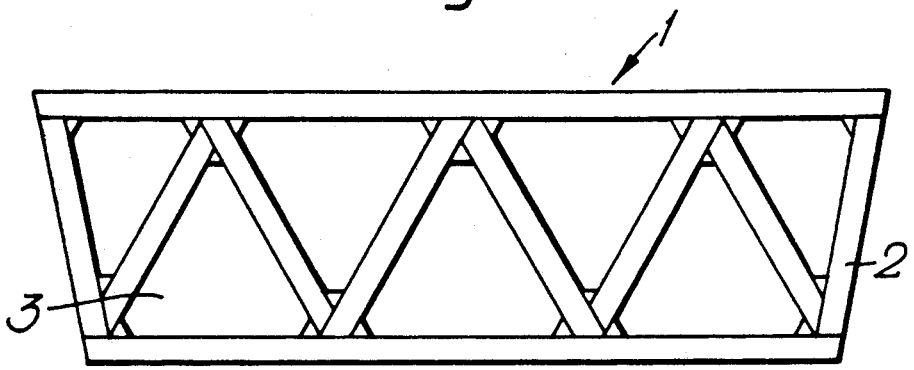
FIG. 1 is a diagrammatic side elevation of a furnace built according to the invention.
Figure 2:
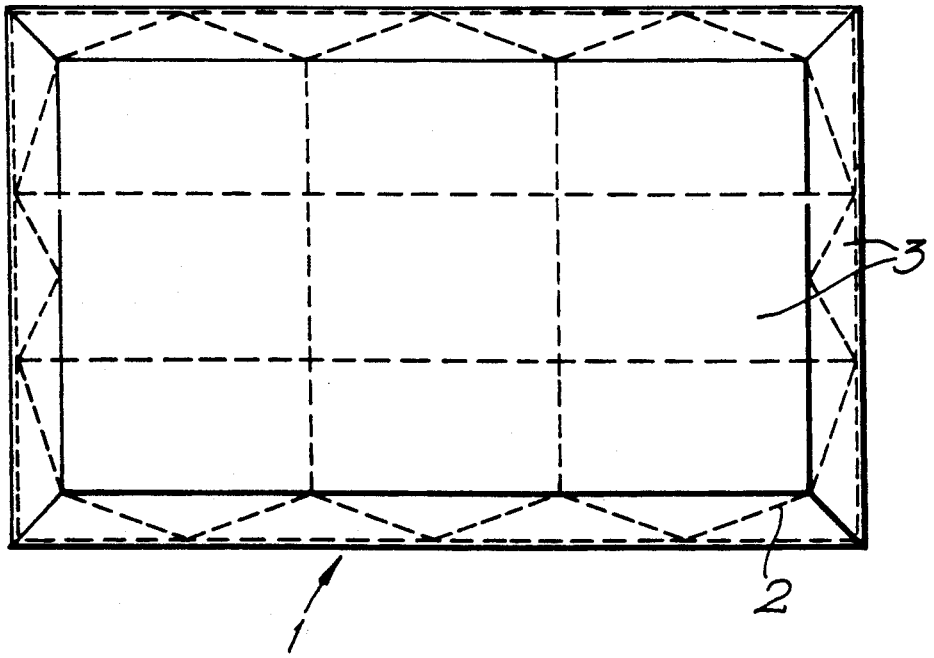
FIG. 2 is a diagrammatic top view of the furnace.

It will appear from FIGS. 1 and 2 that the shown melting furnace 1 is constructed with a supporting structure 2 made of thermostable steel. In this embodiment the supporting structure is a trusswork structure. As shown, the elements of the trusswork structure are arranged and interconnected in a triangulated pattern, i.e., one in which each unit is defined by three linear elements arranged in a triangular pattern and connected in twos at the three respective apices. The furnace comprises a shell of common steel. Said shell is designated 3. Shell 3 forms a supporting basis for a refractory lining, not shown.

FIGS. 1 and 2 only show the furnace box, and the remaining, external carrying and supporting structure is not shown.

Figure 3:
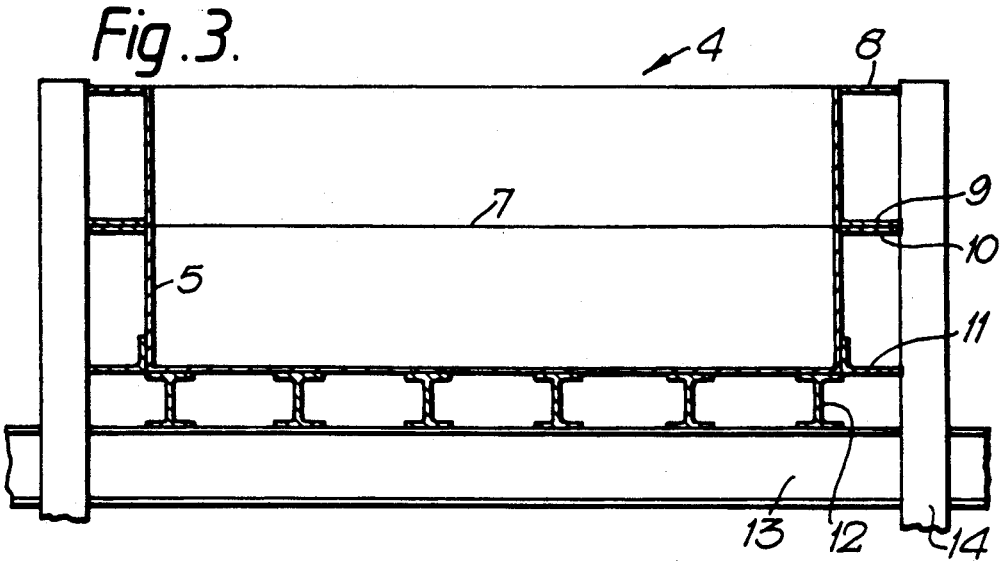
FIG. 3 is a sectional view of another embodiment of a furnace according to the invention.
Figure 4:
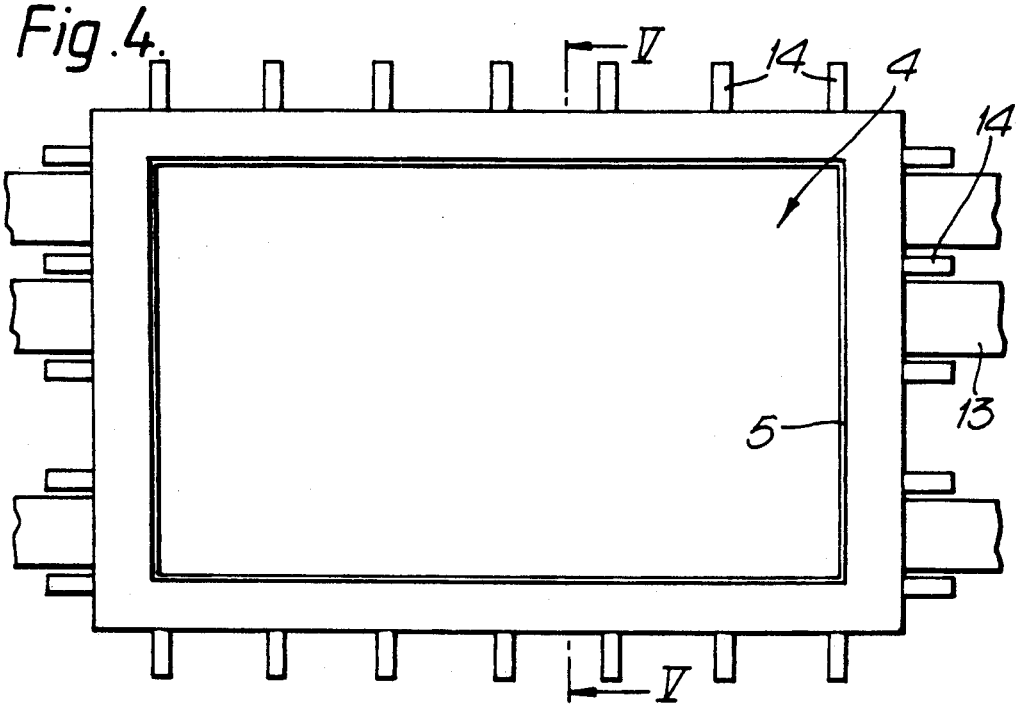
FIG. 4 is a top view of the furnace according to FIG. 3.
Figure 5:
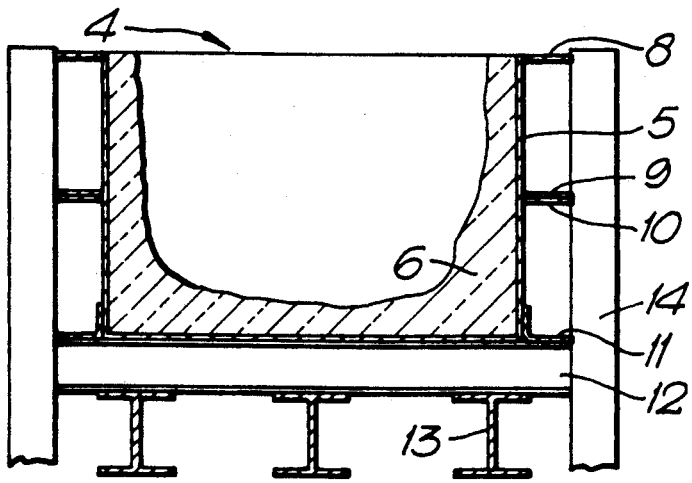
FIG. 5 is a sectional view along line V—V in FIG. 4.

In FIGS. 3-5 an embodiment of a melting furnace with the furnace proper, or box, and an external carrying/supporting structure is shown. The refractory lining of the furnace is not shown in FIGS. 3 and 4, and is just diagrammatically indicated in FIG. 5.

The melting furnace 4, as shown in FIGS. 3-5, is built with a shell 5 of common steel. Said shell 5 forms a bottom, and side walls of the furnace box, and it forms a contact face for refractory lining 6 (only shown in FIG. 5). As shown, especially in FIG. 3, shell 5 is divided in the horizontal plane (seam line 7). This is so only for practical reasons. Externally, shell 5 is strengthened by horizontally extending flanges 8, 9, 10, and 11. Flanges 9 and 10 are bolted together in a manner not shown, so that both shell portions are held together to form the shown shell 5.

The part of shell 5 which forms the bottom of the container rests on a plurality of H-beams 12. Beams 12, in turn, rest on sturdy supporting H-beams 13. Flanges 8, 9, 10, 11 are supported on sturdy steel risers 14.

Mountings of support beams 13 and risers 14 are not shown in detail. Said members form part of what is here called the external supporting and carrying structure, and are made from common steel like shell 5. Only flanges 8, 9, 10, 11, and H-beams 12 are comprised by the supporting furnace structure here, and said members are, thus, manufactured from a suitable thermostable steel material. These components will be be subjected to heat exchange because of being sujected to high temperatures for a long time (up to several years).

A typical, known furnace for aluminium is today made of steel quality St 37-2. Internally, the furnace is lined with refractory material which also insulates against heat transfer from the aluminium bath and towards the steel structure. The heat transfer will vary locally in the furnace.

At the bottom, the temperature of the steel will be 180°-200° C. At the lower parts of the walls, the steel temperature will be 180°-250° C., whereas the steel temperature in the upper parts will be 220°-280° C.

These are normal temperatures in the furnace for the life period of the furnace, for instance, 3-4 years, around the clock.

As stated above, in a conventional furnace, the structure taking the load of aluminium melt and the refractory lining will sag and become lopsided due to the fact that St 37-2 steel will loose its stability when subjected to long term temperatures above 200°-250° C.

This problem may, according to the invention, be solved by using thermostable steel which is weldable to St 37-2 steel. A such thermostable steel must be able to keep its stability despite being subjected throughout a period of 3-4 years to temperatures in the range of 350°-450° C.

Usable thermostable steels are found in DIN 17155. A commercial thermostable steel is Avesta 253 MA.

Experience shows that St 37-2 steel loses its stability (load bearing capacity) in a more drastic way than termostable steel when subjected to long term heating.

Stability capacities for St 37-2 and St 50-3 steel are normally related to short term heating, for instance for one or two hours, as in a fire situation, and the information tables thus give the impression that the steel will not be weakened essentially even by temperatures up to 300° C. Practical experience has, however, shown that long term heating will weaken such steel considerably. Long term heating at a temperature level of 300° C. will result in that the steel will have practically no resistance to sagging.

Having described my invention, I claim:

1. A melting furnace for containing a molten material comprising:

a shell for containing the molten material, said shell including a bottom wall and surrounding sidewalls made of common steel;

a lining of refractory material provided on said bottom wall and sidewalls for direct contact with the molten material;

an external supporting structure engaging said bottom wall and said sidewalls of said shell at a plurality of widely distributed locations for sufficiently supporting the shell as to substantially reduce sagging of said shell due to effects of prolonged exposure of said shell to high temperature from the molten material;

said supporting structure being constituted by a skeletal framework of interconnected elements made of a steel which is characterized by being weldable to said common steel, and by being able to withstand being exposed to elevated temperatures in the range of 180° C. to 450° C. for a period in the range of 3 to 4 years, due to being disposed in a heat exchange relationship with said shell, without substantial loss of stability, said skeletal framework comprising a network of trusses and comprising a plurality of outwardly projecting flanges having inner sides welded to outer sides of said shell.

2. The melting furnace of claim 1, wherein:

said interconnected elements of said skeletal framework of said supporting structure are arranged and interconnected in a triangulated pattern in which each unit is defined by three linear elements arranged in a triangular pattern and interconnected in twos at three respective apices.

* * * * *